United States Patent [19]

Scull

[11] Patent Number: 4,688,454

[45] Date of Patent: Aug. 25, 1987

[54] OPEN-ENDED, HIGH TORQUE WRENCH FOR USE ON NUTS TO WHICH THERE IS LIMITED ACCESS

[75] Inventor: Robert D. Scull, Kent, Wash.

[73] Assignee: The Boeing Company, Seattle, Wash.

[21] Appl. No.: 759,658

[22] Filed: Jul. 26, 1985

[51] Int. Cl.[4] ..... B25B 13/02; B25B 23/16

[52] U.S. Cl. ..... 81/119; 81/177.8

[58] Field of Search ..... 81/119, 121, 176.1, 81/176.15, 176.2, 177.1

[56] References Cited

U.S. PATENT DOCUMENTS

| | | | |
|---|---|---|---|
| 661,011 | 10/1900 | Converse . | |
| 1,276,071 | 8/1918 | Ringling . | |
| 1,479,772 | 1/1924 | Cook . | |
| 1,861,207 | 5/1932 | Burns . | |
| 1,942,492 | 1/1934 | Ratigan | 81/177.1 |
| 2,334,069 | 11/1943 | Collins et al. | 81/90 |
| 2,618,996 | 11/1952 | Logan | 81/111 |
| 3,875,828 | 4/1975 | Evans | 81/119 |
| 4,130,032 | 12/1978 | Giandomenico et al. | 81/119 |
| 4,222,293 | 9/1980 | Schrever et al. | 81/90 |

FOREIGN PATENT DOCUMENTS

| | | | |
|---|---|---|---|
| 84427 | 10/1938 | France . | |
| 13266 | 3/1916 | United Kingdom . | |
| 2122524A | 1/1984 | United Kingdom | 81/119 |

*Primary Examiner*—Frederick R. Schmidt
*Assistant Examiner*—Maurina Rachuba
*Attorney, Agent, or Firm*—Eugene O. Heberer

[57] ABSTRACT

The invention is a single jaw (52) seven point (70, 72, 74, 76, 78, 80 and 82) open-ended wrench (50) having a double square socket (64) attached to one opposite ends (60) spaced by an opening (62) from the other opposite end (58). The jaw (52) is dynamically stiffened and has a substantial jaw support (66). Where the arc of the jaw ends, there are flat surfaces (96, 102 and 98, 104) to receive opposite flat sides (108, 110) of a six point nut (112) or the nut may be received by moving the wrench in the direction of the axis of the nut to thereby engage it. The drive socket (64) is positioned at 90° from the jaw opening (62).

19 Claims, 8 Drawing Figures

OPEN-ENDED, HIGH TORQUE WRENCH FOR USE ON NUTS TO WHICH THERE IS LIMITED ACCESS

DESCRIPTION

1. Technical Field

The invention relates to wrenches usable where limited access normally requires an open-ended wrench and which requires a high torque capacity.

2. Background Art

In aircraft hydraulic systems, for example, the hydraulic tubing is typically closely spaced and requires the use of wrenches to tighten typical flare nuts joining the tubing. Further, in modern aircraft the hydraulic pressure in the tubing is of the order of 3,000 pounds per square inch, the tubing being typically made of titanium. At such pressures 1800 inch/pounds of torque are required to make the flare nut joints leakproof. In the prior art, for example, on steel tubing 1200 inch/pounds of torque were required for lower hydraulic pressures and for still lower pressures, when aluminum tubing was used the torque required was 600 inch/pounds.

The tubing is typically arranged where clearance around a nut point is limited to about 0.2" for a wrench on the nut. That is, the wrench must be rotated in an arc when tightening a nut so that the distance from the points on the nut, or the points in the wrench engaging the nut, to the outer surface of the wrench is about 0.2".

Existing wrenches of the nine point or twelve point crowfoot-type have had a square drive socket located at the lower center of the jaw, and in the nine point open end wrench, the socket is opposite the open end. These jaws were typically arranged for right or left hand engagement.

These existing wrenches have presented the problems of spreading and slipping off of the nut when high torques are applied. If the jaw of the wrench was open-ended, as in a nine point wrench, at high torques the jaws typically spread so as to not be able to provide leakproof hydraulic systems. In addition when a wrench slips while high torque is being applied, there is a danger to the operator in that his arm or elbow can be severly damaged by contact with surrounding equipment as a result of sudden and uncontrolled movement of the wrench handle.

A search of the patent literature discloses a number of wrenches. For example, U.S. Pat. No. 4,130,032 to Giandomenico et al. illustrates a wrench having an open end but which has the characteristics of a closed-end wrench. The wrench includes a sleeve forming a nut-engageable socket with a gap in its side, and an adapter forming a socket with a gap in its side, the adapter closely surrounding the sleeve and extending across the gap in the sleeve. The sleeve and adapter have surfaces that become fully engaged when a wrench handle is applied to the adapter to turn it so as to tighten a nut engaged by the sleeve. This wrench has a relatively complicated structure and requires substantial clearance because the sleeve fits over the nut and within the jaw of the wrench.

The following patents disclose additional wrenches found in the search:

U.S. Ser. No. 661,011, M. D. Converse
U.S. Ser. No. 1,276,071, W. L. Ringling
U.S. Ser. No. 1,479,772, W. H. Cook U.S. Ser. No. 1,861,207, F. J. Burns
U.S. Ser. No. 2,334,069, E. T. Collins et al.
U.S. Ser. No. 2,618,996, G. T. Logan
U.S. Ser. No. 3,875,828, Evans
U.S. Ser. No. 4,222,293, Schrever et al.
British No. 13,266, A. W. King
French No. 84,427, L. Bonnhoff.

DISCLOSURE OF THE INVENTION

The invention is an open-ended, high torque wrench for use on nuts to which there is limited access. The wrench has a jaw of substantial arc form. The arc-shaped jaw terminates in two opposing ends having an opening therebetween. The jaw has a series of equally and circumferentially spaced notch-shaped internal points extending toward the outer surface of the jaw. The internal points are positioned to receive and engage points of a properly sized and shaped nut, the points of the nut joining flat sides of the nut. The points of the nut and points of the arc are generally parallel to the axis of the nut when the respective points are engaged.

There is a wrench socket for engagement by a handle, the socket extending outwardly of and adjacent one of the two opposing ends of the jaw. The socket is positioned to have its center in substantial alignment with two internal opposite points in the jaw, each of the last two internal points being adjacent a respective opposing end. A line through the jaw center and in alignment with the last internal points in substantially perpendicular to an arc center line centrally spaced between the opposing ends.

The jaw and socket are rotated by a click-type torque wrench handle engaged in the socket. The jaw, when rotated by the handle, is adapted to grip and rotate the nut having points engaged in the internal points of the jaw. The jaw, when so engaging the nut and being rotated is in tension around the arc and the nut to prevent the jaw from spreading and slipping on the nut.

The wrench has seven internal points which are formed substantially within a semicircle and the arc including the opposing ends extends about 240°. The jaw is formed to engage four, six, and twelve point nuts in the direction of the axis of the nuts, the internal points of the jaw being slidable onto the points of the nut. Each of the opposing ends has an outer flat surface, the outer flat surfaces facing each other and being formed to engage opposite flat sides of a properly shaped and sized nut, and engage points of the nut in internal points of the jaw for rotation of the nut.

Five of the seven internal points are formed within the jaw away from the opposing ends and two of the seven points are fomed within the jaw adjacent the opposing ends. One half of the last two points and the five points are formed within a semicircle of the arc.

There is an internal point immediately inwardly of the outer flat surface of each opposing end. The semicircle of the jaw terminates at said last internal points immediately inwardly of the outer flat surface of each opposing end. There is an inner flat surface immediately inwardly of each last internal point within the semicircle. The inner flat surfaces oppose each other so that they may engage opposite flat sides of the nut, respectively, engaged by the outer flat surfaces of the jaw.

The socket is a double square drive socket having eight notch-shaped points equally and circumferentially spaced so that each of two sets of four alternate points engage four points of a square protrusion on the handle, the protrusion fitting into the socket for rotation of the jaw. The socket has a full depth for left hand and right hand insertion of the wrench handle. The double square provides for twice the articulation by changing the position of the protrusion in the socket.

While the wrench may be made for use on square nuts, typical nuts for use in limited access areas are six point and twelve point nuts and the wrench has been made in nominal wrench sizes from 7/16 inches to $2\frac{7}{8}$ inches.

The wrench has been dynamically stiffened in the jaw with respect to the prior art but is usable for clearances of 0.2" between the outer points of a nut and the environment in which the wrench must rotate the nut. Because of the arrangement of the socket on one of the opposing ends of the jaw arc, at 90° from the center of the open end, rotation of the jaw on a nut puts the entire jaw, end-to-end, in tension around the nut to prevent the jaw from spreading and slipping on the nut. This arrangement makes the jaw suitable to apply 1800 inch-/pounds torque on titanium nuts to achieve leakproof hydraulic systems containing 3,000 pounds per square inch of hydraulic fluid.

The seven point jaw provides for the two way access to a nut, that is, the sliding of the wrench onto the flat sides of a hexagon nut, or the sliding of the wrench onto a hexagon or twelve point nut in the direction of the axis of the nut along a tube which the nut is designed to join with another tube. The single jaw design resists torque forces by spanning the nut in tension. The wrench also provides increased safety for maximum torquing, eliminating bending and slipping of the wrench on the nut while the jaw is tightening in tension.

Further advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings which are for illustrative purposes.

BEST MODE FOR CARRYING OUT THE INVENTION

Figure 1:
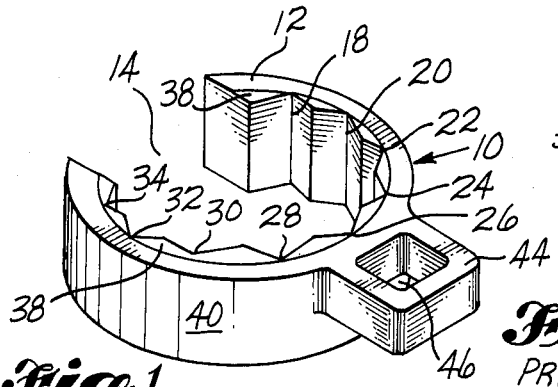
Fig. 1 PRIOR ART
FIG. 1 is a pictorial view of a prior art nine point open-ended wrench.
Figure 2:
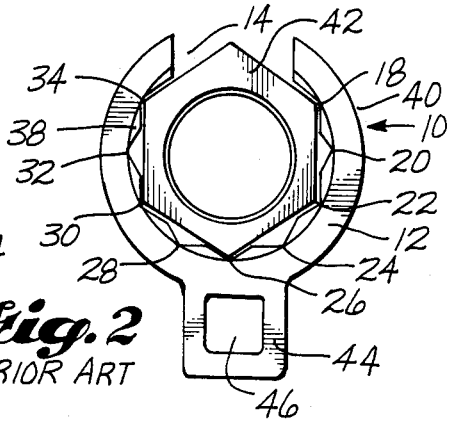
Fig. 2 PRIOR ART
FIG. 2 is a plan view of the prior art wrench shown in FIG. 1 engaged with a six point nut.
Figure 3:
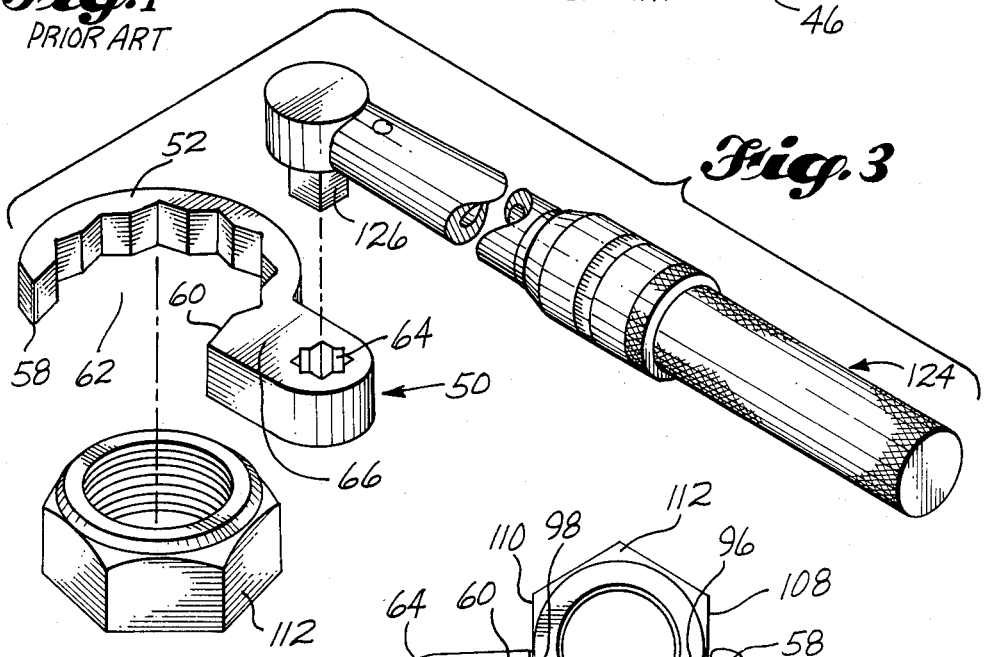
FIG. 3 is an exploded pictorial view of a six point or hexagon nut in position to be engaged in a seven point wrench, according to the invention, and a click-type torque wrench handle positioned to be engaged in a double square socket in the wrench.

Referring again to the drawings, in FIGS. 1 and 2 there is illustrated a nine point crowfoot-type wrench, generally designated as 10, as used in the prior art. The wrench is formed as an arc 12 having an open end 14, and having nine notch-shaped internal points 18 ,20, 22, 24, 26, 28, 30, 32, and 34 extending toward the outer surface 40 of the arc, and adapted to engage points of a six point or hexagon nut 42, or a twelve point nut, not shown. The jaw is relieved as at 38 around the points. Such nuts are typically used in areas in aircraft where there is little access to the nuts, such as flare nuts which join hydraulic lines.

A square socket 44 extends from the center at the end of the arc, opposite the open end 14, and is adapted in its square opening 46 to receive a rectangular protrusion on the end of a click-type torque wrench handle.

The problem with such wrenches has been that at high torques the jaw spreads and slips on the nut so as to not be able to tighten the nut to make leakproof hydraulic joints. When they slip at a high torque, there is a danger to the operator in that his arm may be forced against surrounding structure so as to do significant injury to the arm or elbow, or damage the surrounding structure.

The prior art wrench 10 is adapted for engaging six and twelve point nuts, when moved along a tube being connected, along the axis of the nut, as indicated in FIG. 2.

In FIGS. 3–7, and 8 there is shown a high torque wrench, according to the invention, generally designated as 50, for use in limited access areas. The wrench is formed generally as an arc-shaped jaw 52 having an outer circumferential surface 54, and having two opposing ends 58 and 60 spaced by an open end 62.

Figure 7:
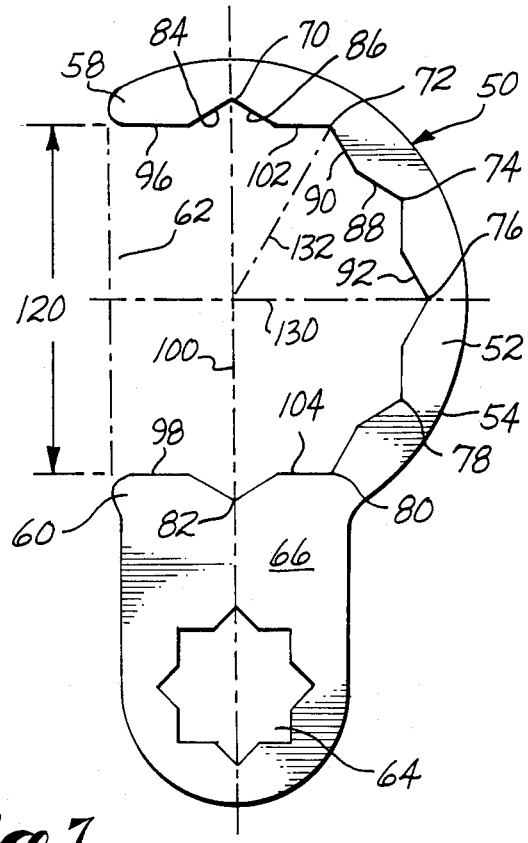
FIG. 7 is a plan view of a larger embodiment of the invention.

A double square socket 64 is strongly supported to end 60 by a relatively heavy supporting protrusion 66. The arc 52 is dynamically stiffened with respect to the prior art for improved access, compared with the prior art. As best seen in FIG. 7, the jaw 52 has seven notch-shaped points 70, 72, 74, 76, 78, 80, and 82, circumferentially and equally spaced, extending outwardly toward the circumference 54. Each of the notch-shaped points is formed by two flat surfaces or walls, as 84 and 86. The flat wall surface 86 is in alignment with a flat surface 88 forming one-half of the point 74 and similarly, an inner flat surface 90 is in alignment with a flat surface 92, forming one-half of the notched internal point 76.

Figure 4:
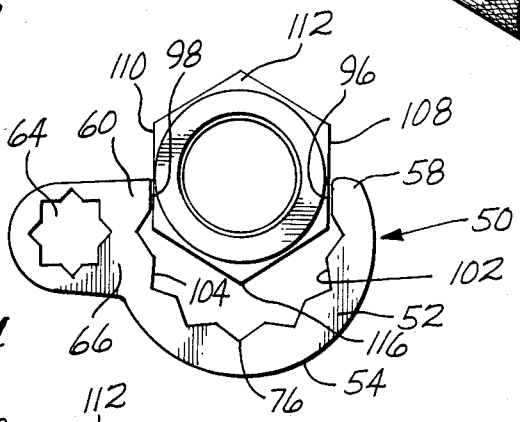
FIG. 4 is a plan view of a wrench, according to the invention, engaging a six point nut on opposite flat sides of the nut.

The opposing ends 58 and 60 have outer flat surfaces 96 and 98, facing each other. A line of direction extends generally through the opposing ends and the protrusion 66. The outer flat surfaces 96 and 98 are outwardly of a semicircle of arc indicated by the broken line 100, and inner flat surfaces 102 and 104 are inwardly within the semicircle to the right of the broken line 100, FIG. 7. The flat surfaces 96 and 102 and 98 and 104, FIG. 4, are respectively aligned to receive or be slipped over opposite flat sides 108 and 110 of a six point nut 112. This type of nut is typically used as a flare nut to engage flares, not shown, adjacent the ends of hydraulic tubing as 114, FIG. 8, that are to be joined together.

As may be seen in FIG. 4, as the wrench is moved farther onto the nut, the flat sides 108 and 110 will become engaged with the flat surfaces 102 and 104, respectively, and a nut point 116, formed by joined flat sides of the nut, will be moved into notch point 76, and the flat sides of the nut will engage the flat surfaces forming the notch. When this occurs the nut will then be in position to be rotated by the wrench. The ability to engage the nut through the open ends of the jaw provides a substantial advantage over the prior art. As indicated in FIG. 7, the distance 120 is equal, within the usual tolerances, to the distances between flat sides of a six point nut.

The rotation of the wrench 50 may occur when a click-type torque wrench handle, generally designated as 124, has its square tang or protrusion 126 engaged in a double square socket 64. As may be best seen in FIG. 7, the double square drive socket has eight notch-shaped points, equally and circumferentially spaced so that each set of four alternate points may engage four points of the square protrusion 126 on the handle. The double square socket permits twice the articulation of the wrench in any particular position when the wrench is changed in the socket from one set of four points to the alternate set.

The socket is positioned to have its center in substantial alignment with the two internal opposing points 70 and 82 in the jaw, as an extension of the line 100 indicates. The line through the socket center is substantially perpendicular to an arc center line 130, centrally spaced between the opposing ends 58 and 60, the socket being 90° from the jaw opening 62. Thus, the jaw, when rotated by the handle engaged in the socket, grips and rotates the nut, having points engaged in the internal points or between the flat sides adjacent the ends. The jaw, when so engaging the nut and being rotated, is in tension from the end 58 to the lower support 66 to prevent the jaw from spreading and slipping.

In a six point nut the points are 60° apart; whereas in a twelve point nut, the points are 30° apart, as is the angle between the line 100 and the line 132, FIG. 7. Thus, the points of a twelve point nut would be engaged at 30° apart rather than at 60° for a six point nut. As may be noted in FIG. 7, beyond the semicircle, toward the open end outwardly of points 70 and 82, there is an additional 30° of arc above and below the line 130 so as to indicate the wrench has a total arc of approximately 240°.

Figure 5:
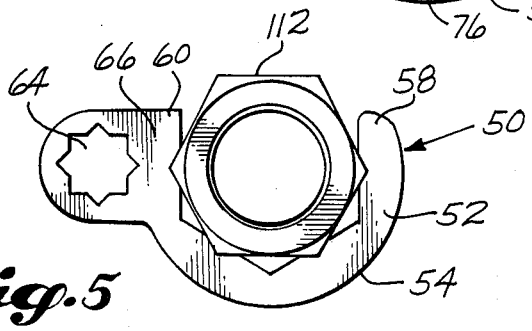
FIG. 5 is a view of the same nut and wrench in FIG. 4 in which the wrench has engaged the nut along the axis of the nut.
Figure 8:
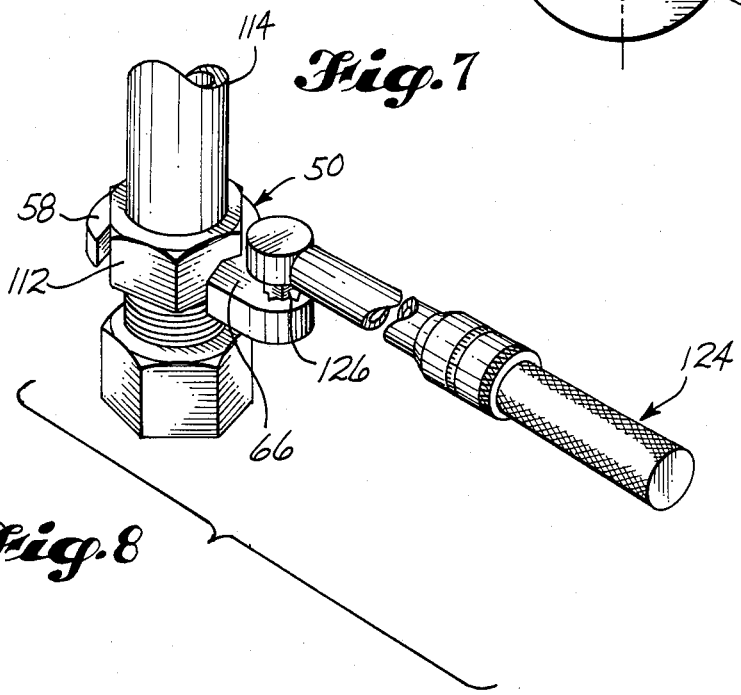
FIG. 8 is a pictorial view of the wrench engaging a nut for tightening on a tube, the rotation being applied through a click-type torque wrench handle.

In FIG. 5, the nut 112 has been engaged by moving the wrench along the tube, as 114, FIG. 8, and along the axis of the nut so that four points of the nut are engaged with four internal points of the jaw. In this position a greater torque can be applied to the nut than as shown in FIG. 4 but it is not as convenient to engage the nut as in FIG. 4.

By having the double square drive socket extended for the full thickness of the jaw, it can be engaged for either a left hand or a right hand operation as distinct from the prior art socket 44 which only extends approximately halfway relative to the thickness of the jaw. In applying the torque to the ends of the jaw from one end so as to put nearly the entire jaw in tension, there is substantial advantage over the prior art where the load is applied to the center of the jaw through the socket 44, the area 66 being in compression.

Figure 6:
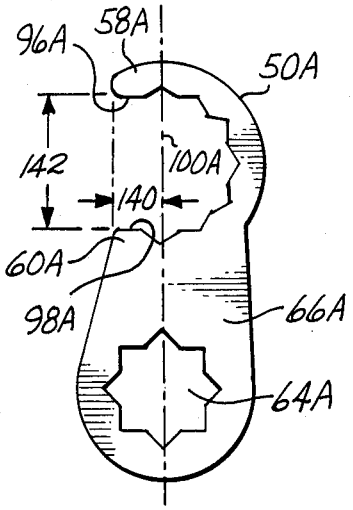
FIG. 6 is a plan view of an embodiment of a small wrench, according to the invention.

In FIG. 6, another embodiment of the wrench 50 is shown as 50A. This embodiment illustrates a concept of the invention that is relatively small so that the distance 140 indicated between the arrows from the center line 100A to the ends 58A and 60A is less than one-half of the distance 142 between the outer facing flat surfaces 96A and 98A. For this size wrench the area at 66A and around the socket must be made proportionately greater than that shown in FIG. 7 for a larger wrench.

From the foregoing, it is clear that the present invention provides increased torque capability, eliminates nut climbing and jaw spreading, increases the safety for the operator for maximum torquing, has a more versatile usage, greater mechanical advantage, increased articulation, and excels in leakproof torquing of hydraulic tube assemblies in comparison to the prior art wrenches.

The invention and its attendant advantages will be understood from the foregoing description and it will be apparent that various changes may be made in the form, construction, and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims.

What is claimed is:

1. An open-ended, high torque wrench for use on a nut of selected size to which there is limited access, comprising:

a wrench having a jaw formed substantially as an arc, the substantial arc having an open-end and having two spaced opposing ends of the arc at the open-end, said open-end sized to engage said nut from a direction perpendicular to the rotational axis of said nut;

said arced-jaw having a thickness and having a series of equally and circumferentailly spaced internal notch-shaped points extending toward an outer surface of the arc; each notch-shaped point having two flat walls extending outwardly toward the outer surface of the arc and being joined at their outer ends to form a notch-shaped point;

said internal notch-points being engageable with respective points of a properly sized nut, and which nut points are formed at ends of two flat sides of the nut; the flat sides forming each nut point being engageable with at least one respective flat wall of a notch-point in which the nut point is engageable; the points of the nut and points of the arc being generally parallel to the axis of the nut when the respective points are engaged; and a protrusion extending along the jaw from one of said opposing ends from adjacent the open-end, said protrusion extending outwardly away from the jaw and from the one opposing end along a line of direction generally through said opposing ends said protrusion having a thickness substantially equal to the thickness of said jaw;

a wrench socket extending through said protrusion, the socket extending generally parallel to the axis of the nut when the respective nut and arc points are engaged;

the wrench socket being engageable by a handle for rotating the arced-jaw for rotating a nut;

when said nut points are engaged in the arc points and said arced-jaw is rotated by the handle, whereby said nut is gripped and rotated for tightening or loosening on a threaded fitting, said jaw being in tension around the nut as it is rotated to prevent said jaw from spreading and slipping on the nut.

2. The invention according to claim 1 in which:

each of said opposing ends has a flat surface, said flat surfaces facing each other;

said opposing flat surfaces being engageable with opposite flat sides of a properly sized and shaped nut on and through said flat surfaces and at least one point of the nut being engageable in said internal points of the arc for rotation of the nut.

3. The invention according to claim 1 in which:

said arced-jaw being engageable with a properly sized nut in the direction of the axis of said nut, internal points of the arc being slidable onto points of the nut.

4. The invention according to claim 3 in which:

said flat wall forming the internal points being positioned to engage flat sides joined at nut points substantially within the semicircle.

5. The invention according to claim 3 in which:

said internal points are formed substantially within a semicircle of said arc.

6. The invention according to claim 1 in which:

said socket is a double square drive socket having eight notch-shaped points, equally and circumferentially spaced so that each of two sets of four alternate points may engage four points of a square protrusion on the handle, the protrusion fitting into the socket for rotation of the jaw.

7. The invention according to claim 1 in which:

said internal points are formed substantially within a semicircle of said arc.

8. The invention according to claim 7 in which:

each of said opposing ends has an outer flat surface extending outwardly of said semicircle, said outer flat surfaces facing each other;

said opposing flat surfaces being engageable with opposite flat sides of a properly sized nut, on and through said outer flat surfaces, and at least one point of the nut being engageable in an internal point of the arc for rotation of the nut;

an inner flat surface inwardly of each of said opposing ends and being within said semicircle, said inner flat surfaces facing each other;

each outer flat surface being in longitudinal alignment with an inner flat surface adjacent a corresponding opposing end so that said inner flat surfaces engage the same flat sides of a nut for rotation as do the corresponding outer flat surfaces.

9. The invention according to claim 8 in which:

said arc including said opposing ends extends for about 240°.

10. The invention according to claim 1 in which:

said wrench has seven internal points.

11. An open-ended, high torque wrench for use on a nut to which there is limited access, comprising:

a wrench having a thickness and having a jaw of substantial arc form, the arc-shaped jaw terminating in two spaced opposing ends having an open-end therebetween said open-end sized to engage said nut in a direction perpendicular to the rotational axis of said nut;

said arc-shaped jaw having a series of equally and circumferentially spaced notch-shaped internal points extending toward an outer surface of the jaw; each notch-shaped point having two flat walls extending outwardly toward the outer surface of the arc and being joined at their outer ends forming the notched-shaped point;

said internal notch-shaped points being engageable with respective points of a properly sized nut, and which nut points are formed at an end of two flat sides of the nut; the flat sides forming each nut point being engageable with at least one respective flat wall of a notch-point in which the nut point is engageable; the points of the nut and points of the arc being generally parallel to the axis of the nut when the respective points are engaged; and a protrusion extending along the jaw from one of said opposing ends from adjacent the open-end, said protrusion extending outwardly away from the jaw and from the one opposing end along a line of direction generally through said opposing ends said protrusion having a thickness substantially equal to the thickness of said jaw;

a wrench socket extending through said protrusion, the socket extending generally parallel to the axis of the nut when the respective nut and arc points are engaged;

the socket having its center in substantial alignment with two internal opposing points in the jaw, each of said last two internal points being adjacent a respective opposing end;

a line through said jaw center and in said alignment with said last internal points and being substantially perpendicular to an arc center line centrally spaced between the opposing ends;

whereby said nut is gripped and rotated for tightening or loosening on a threaded fitting by said jaw, said jaw being in tension around the nut as it is rotated to prevent said jaw from spreading and slipping on the nut.

12. The invention according to claim 11 in which:

said wrench has seven internal points.

13. The invention according to claim 12 in which:

five of said seven points are formed within the jaw away from said opposing ends;

two of the seven points are formed within the jaw adjacent the opposing ends;

one half of the last two points and said five points are formed within a semicircle of the arc.

14. The invention according to claim 12 in which:

said internal points are formed substantially within a semicircle of said arc.

15. The invention according to claim 11 in which:

said arc including said opposing ends extends for about 240°.

16. The invention according to claim 11 in which:

said jaw is formed to engage four, six, and twelve point nuts in the direction of the axis of the nuts, internal points of the jaw being slidable onto points of the nut.

17. The invention according to claim 11 in which:

each of said opposing ends have an outer flat surface, said outer flat surfaces facing each other;

said facing surfaces being engageable with opposite flat sides of a properly shaped and sized nut, on and through said outer flat surfaces, and at least one point of the nut being engageable in one internal point of the arc for rotation of the nut.

18. The invention according to claim 17 including:

an internal point immediately inwardly of said outer flat surface of each opposing end;

a semicircle of said jaw terminating at said last internal points immediately inwardly of said outer flat surface of each opposing end; and an inner flat surface immediately inwardly of each last internal point within said semicircle, said inner flat surfaces opposing each other so that they may engage said opposite flat sides of said nut respectively engaged by said outer flat surfaces of said jaw.

19. The invention according to claim 11 in which:

said socket is a double square drive socket having eight notch-shaped points, equally and circumferentially spaced so that each of two sets of four alternate points may engage four points of a square protrusion on the handle, the protrusion fitting onto the socket for rotation of the jaw.

* * * * *

UNITED STATES PATENT AND TRADEMARK OFFICE

CERTIFICATE OF CORRECTION

PATENT NO. : 4,688,454

DATED : August 25, 1987

INVENTOR(S) : Robert D. Scull

It is certified that error appears in the above-identified patent and that said Letters Patent are hereby corrected as shown below:

On the cover page, in the listing of "FOREIGN PATENT DOCUMENTS", number "84427" listed for the French patent should be -- 844,276 --.

In the Abstract, third line, "to one" should be followed by -- of --.

Column 1, line 66, through column 2, line 5, in each line "Ser. No." should be -- Pat. No. --.

Column 2, line 7, "No. 84,427" should be -- 844,276 --.

Column 2, line 29, "in" should be -- is --.

Claim 1, column 6, line 25, "circumferentailly" should be -- circumferentially --.

Signed and Sealed this

Seventeenth Day of May, 1988

*Attest:*

*Attesting Officer*

DONALD J. QUIGG

*Commissioner of Patents and Trademarks*